US005180298A

United States Patent [19]

DiRe

[11] Patent Number: 5,180,298

[45] Date of Patent: Jan. 19, 1993

[54] HYDRAULIC PUMP WITH FOAMED ELASTOMERIC MEMBER IN OUTLET CHAMBER TO REDUCE LIQUID-BORNE NOISE

[75] Inventor: John DiRe, Charlotte, N.C.

[73] Assignee: IMO Industries Inc., Princeton, N.J.

[21] Appl. No.: 644,451

[22] Filed: Jan. 23, 1991

[51] Int. Cl.[5] ..... F04C 15/00

[52] U.S. Cl. ..... 418/181; 418/196; 417/312; 181/208

[58] Field of Search ..... 418/181, 196; 417/312; 181/222, 233, 256, 258, 271, 207, 208, 209

[56] References Cited

U.S. PATENT DOCUMENTS

| | | | |
|---|---|---|---|
| 1,751,703 | 3/1930 | Long | 418/181 |
| 3,033,306 | 5/1962 | Hallene et al. | 181/233 |
| 3,134,611 | 5/1964 | Iverson | 417/312 |
| 3,385,396 | 5/1968 | Morris | 181/233 |
| 3,489,242 | 1/1970 | Gladding et al. | 181/208 |
| 3,789,954 | 2/1974 | Raleigh | 417/312 |
| 3,918,541 | 11/1975 | Krieger | 181/207 |
| 4,135,602 | 1/1979 | Clark | 418/181 |
| 4,860,851 | 8/1989 | Krevor et al. | 181/208 |
| 5,013,221 | 5/1991 | Tuckey | 417/312 |

FOREIGN PATENT DOCUMENTS

| | | | |
|---|---|---|---|
| 63-246999 | 10/1988 | Japan | 181/208 |

*Primary Examiner*—Richard A. Bertsch
*Assistant Examiner*—David L. Cavanaugh
*Attorney, Agent, or Firm*—Hopgood, Calimafde, Kalil, Blaustein & Judlowe

[57] ABSTRACT

A noise-absorbing medium is provided as an insert within the inner volume of the outlet chamber of a displacement-type pump. In an axial-flow displacement pump, this is the chamber into which pumped hydraulic fluid is discharged, for side-ported delivery to piping which serves the end-use actuator or other use component of the involved hydraulic system. The noise-absorbing medium is a preformed body (or bodies) of foamed elastomeric material having a sealed external skin and containing tiny closed cells of entrapped gas at low pressure; the encapsulated gas within the body bears a predetermined fractional volumetric proportion to the overall volume of the body, and the overall volume of the body also bears a predetermined relation to the overall volume of the outlet chamber.

8 Claims, 3 Drawing Sheets

HYDRAULIC PUMP WITH FOAMED ELASTOMERIC MEMBER IN OUTLET CHAMBER TO REDUCE LIQUID-BORNE NOISE

BACKGROUND OF THE INVENTION

This invention relates to means for reducing noise generated by operation of a hydraulic pump such as a displacement-type rotary pump designed for axial flow.

Liquid-pumping machinery will generate a flow ripple measured as a fluctuation in the developed pressure. It is necessary to control the magnitude of this pulsation in order to effectively operate a fluid-pumping system without undue noise, vibration and eventual equipment failure.

Low-noise operation of liquid-pumping systems requires methods to control pressure pulsations generated by the pump. The practice today is to use acoustical devices which fall into one or more of the following categories:

1. Expansion chambers, or large volumes. These work well over a broad frequency range; however, they necessarily involve large pressure vessels and tend to be very heavy and expensive.

2. Gas-filled accumulators. These provide good noise reduction in the lower frequency ranges; however, they have the disadvantage of requiring maintenance, and they tend to be expensive.

3. Helmholtz resonators. These provide effective attenuation above their resonant frequency but fall short at low frequency due to size limitation, and they too are expensive.

Generally, most available methods tend to provide more attenuation than is necessary and become too costly for competitive applications. Thus, unfortunately, noise problems fail to get resolved.

Pumps of the character indicated find important application to operation of hydraulic elevators, as for example in a hotel or apartment house where noise must be kept to an absolute minimum, in consideration of those residents whose accommodations are near an elevator shaft. The pump in such a system is immersed in the sump, and of course any pulsation in pump operation will be transmitted directly and hydraulically to the plunger or other end-use actuator of the system; operating pressures are in the order of hundreds of pounds per square inch, and further noise can be transmitted to support structure via piping which connects the pump to the end-use actuator or actuators. To apply effective noise-reduction techniques to the piping calls for custom design, which may be and often is economically wasteful, being the product of empiricism under the direction of inadequately skilled installation personnel. And once noise is tolerated in the piping, the problem of noise reduction involves both liquid-borne noise as well as structure-borne noise, propagated via the material of the piping. High-level structure-borne noise very often can result in high-level airborne noise.

Generally, a three-screw pump of the variety commercially available from the Imo Pump Division of Imo DeLaval Inc., Monroe, N.C., is to be desired for applications of the character indicated. This three-screw pump is a positive rotary pump with axial-flow design. The central one of three screws is motor-driven, and the two further screws are idlers meshing with diametrically opposed portions of the driven central screw, the idlers acting as sealing elements that are rotated hydraulically by the fluid being pumped. The rolling action which characterizes idler reaction to the hydraulic fluid accounts for a continuous-non-pulsating axial flow which, in the case of an end-use elevator, results in a smooth elevator ride, but the smooth ride cannot conceal the presence of hydraulically conveyed noise, which is always objectionable, even if markedly reduced as compared with delivery from other kinds of pump systems.

BRIEF STATEMENT OF THE INVENTION

It is an object to provide improved hydraulic pump structure of the character indicated, having its own provision for noise reduction, whereby to reduce hydraulically transmitted and/or pipe-transmitted noise in a hydraulic system served by the pump.

A specific object is to achieve the above object with relatively simple low-cost structure that lends itself to use in existing pump designs.

Another specific object is to provide noise-reducing structure meeting the above objects, wherein the involved structure can be the product of conventional injection-molding techniques, using commercially available elastomers to produce effective, inexpensive, maintenance-free liquid-borne noise suppression, in the order of 6 to 10 db, and over a broad band of frequencies, prior to discharge from the pump.

The invention achieves these objects by providing a noise-absorbing medium as an insert within the inner volume of the outlet chamber of a displacement-type pump. In an axial-flow displacement pump, this is the chamber into which pumped hydraulic fluid is discharged, for sideported delivery to piping which serves the end-use actuator or other use component of the involved hydraulic system. The noise-absorbing medium is a preformed body (or bodies) of foamed elastomeric material having a sealed external skin and containing tiny closed cells of entrapped gas at low pressure; the encapsulated gas within the body bears a predetermined fractional volumetric proportion to the overall volume of the body, and the overall volume of the body also bears a predetermined relation to the overall volume of the outlet chamber.

DETAILED DESCRIPTION

Illustrative embodiments of a preferred relationship, will be described in detail, in conjunction with the accompanying drawings, in which.

Figure 1:
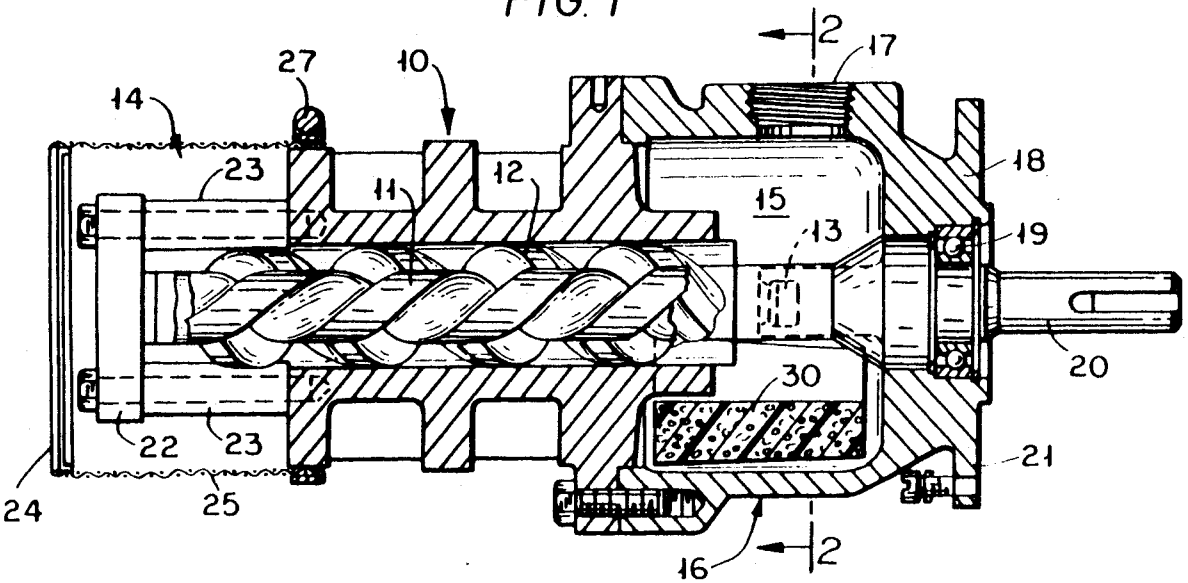
FIG. 1 is a simplified longitudinal section of a three-screw axial-flow displacement pump which includes provision for noise-reduction in accordance with the invention.

Referring to FIG. 1, the invention is shown in application to a so-called three-screw hydraulic displacement pump comprising, within an elongate housing 10, a central elongate power rotor 11 having double-lead right-handed helical groove formations, and two like elongate idler rotors 12, 12', at diametrically opposed offset from the central axis of the power rotor 11. The idler rotors 12, 12' also have double-lead groove formations, to the same pitch as the grooves of the power rotor and in continuous mesh therewith, it being noted that the axial offsets of the idler rotors are such that outer diameters of the idler rotors mesh the idler rotors to the root diameter of the groove formations of the power rotor.

The pump of FIG. 1 is designed for immersion in the liquid to be pumped, from an inlet end 14, to an outlet chamber 15, which in the form shown is defined by a cup-shaped housing-closure member 16 with a generally cylindrical skirt having a side port 17 for delivery of pumped liquid. Diametrically opposed stops 13, 13' are integrally formed with closure member 16, projecting radially inward from the wall of chamber 15. The closure wall 18 of member 16 has a bore and counterbore to define a shoulder for location of a suitably sealed antifriction bearing 19 for support of the driven end 20 of the shaft forming an integral part of the power rotor 11. It will be understood that a flange formation 21 of member 16 may be drilled for peripherally spaced bolted assembly to an electric motor (not shown) having keyed driving engagement to the shaft end 20.

Description of the commercially available three-screw pump of FIG. 1 is completed for present purposes by identifying a thrust plate 22 for the inlet end of power rotor 11. Plate 22 is bolted via bushings 23 to the inlet end of housing 10, such that ample inlet access is afforded for liquid to be pumped; and the apertured end wall 24 and skirt wall 25 of a removable basket provide support for strainer screening 26, for assured absence of solids in fluid admitted to the pump. A circumferential clamp 27 is the means of removably supporting the basket and its screening 26.

In accordance with the invention, a noise-reduction feature is incorporated as a preformed attenuator, namely, an insert body 30 within the volume of outlet chamber 15, without requiring structural redesign of the chamber. In the embodiment of FIG. 1, the insert body 30 is a generally cylindrical crescent, as the same is seen in the end elevation of FIG. 2, and, as seen in the side elevation of FIG. 3, the crescent section of body 30 varies as a function of longitudinal location, tapering gradually in the longitudinal direction toward closure wall 18. Body 30 is a molded elastomer, molded with 20 to 35 percent of its volume as encapsulated gas, and the overall volume of body 30 is in the range of 0.1 to 0.3 of the net value of chamber 15, i.e., chamber volume, as reduced by the necessary presence of the shaft end of power rotor 11. Suitably, and preferably, and for chamber (15) accommodation of hydraulic pressure in the order of 250 to 750 psig, with hydraulic liquid in the temperature range from ambient to 180° F., the elastomer is a so-called high-performance grade DuPont polyester product under the trade name HYTREL. Of the available high-performance grades, HYTREL 6356 is preferred due to its good resistance to oils and hydraulic fluids, and due to its good resistance to permeation by gases and liquids. The foaming agent introduced in the molding of body 30 is suitably ACTIVEX, producing carbon-dioxide gas through thermal reaction, to displace the HYTREL and form gas pockets during the molding process; ACTIVEX is a product of the J. M. Huber Company of Havre de Grace, Md.

Figure 3:
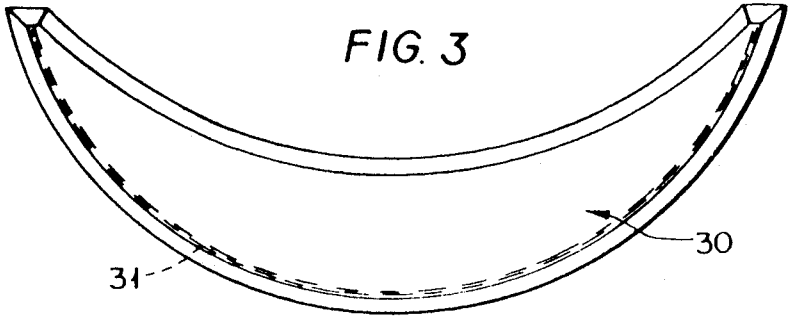
FIG. 3 is an axial-end view of a noise-reducing element of FIG. 1.
Figure 4:
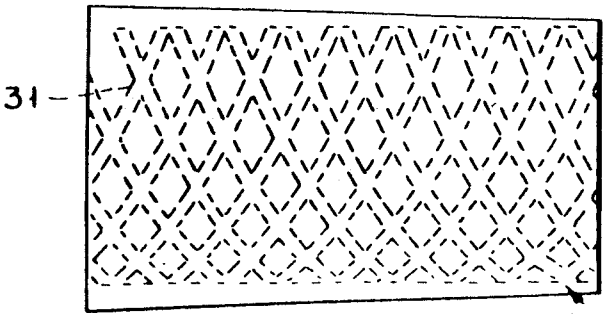
FIG. 4 is a view in side elevation of the noise-reducing element of FIG. 3.

As also seen in FIGS. 3 and 4, the noise-reducing body or attenuator 30 may be molded to contain a reinforcing element 31, shown as a cylindrically arcuate piece of expanded metal.

The encapsulated-gas attenuator may take various forms, suited to the interior contouring of particular outlet chamber designs, and suited to provision of a relatively broad band of attenuated frequencies. To the latter end, in the embodiment of FIGS. 1 to 4, the tapering cylindrical crescent configuration is seen to afford a maximum distribution of different thicknesses, thus avoiding the dominant areas of opposed flat surfaces at constant spacing and thus also materially reducing chances for resonance at any particular dimensionally related spacing.

Figure 6:
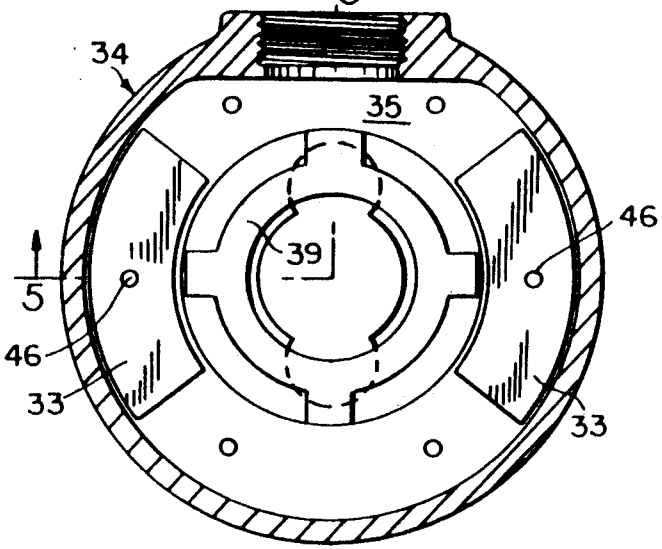
FIG. 6 is a sectional view of the structure of FIG. 5 taken in generally the plane 6—6 of FIG. 5, and indicating that the section of FIG. 5 is generally along the line 5—5 of FIG. 5.
Figure 8:
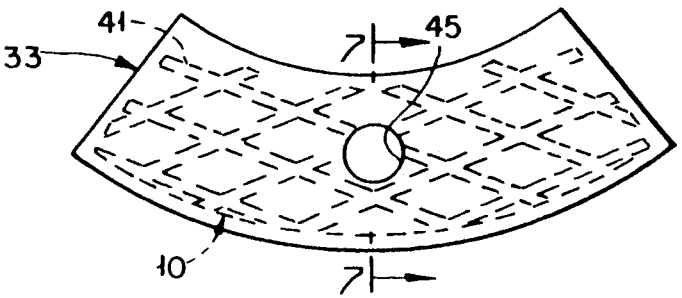
FIG. 8 is an end view of the noise-reducing element of FIG. 7.
Figure 5:
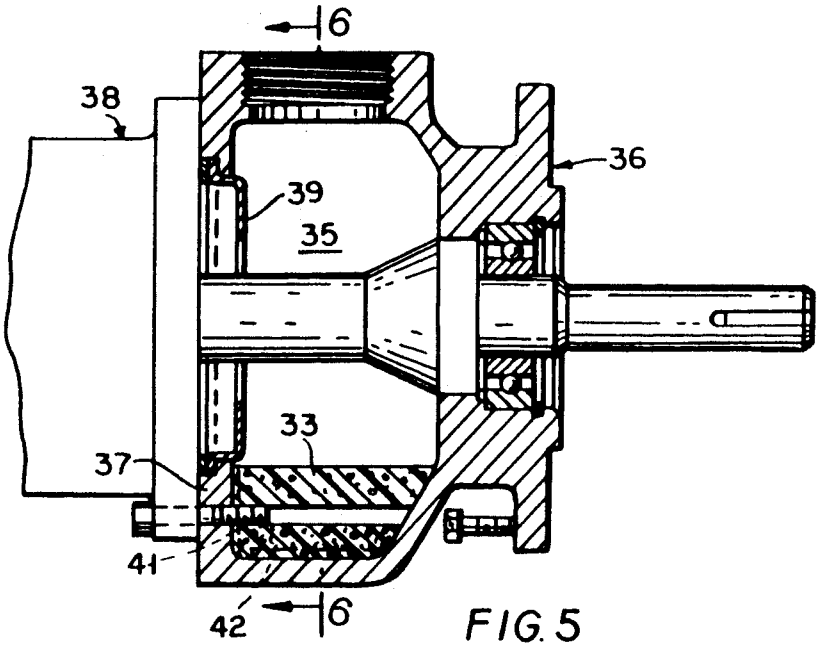
FIG. 5 is a fragmentary view in longitudinal section, to illustrate the invention in application to another axial-flow displacement pump.
Figure 7:
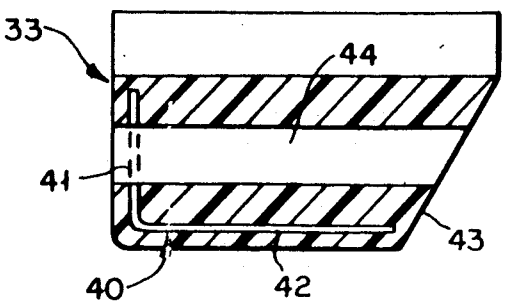
FIG. 7 is a view in longitudinal section, to show detail of one of the two noise-reducing elements of FIGS. 5 and 6.

In the arrangement of FIGS. 5 and 6, two like sound-absorbing bodies 33 are mounted at diametrically opposite arcs of the interior volume of a different housing-closure member 34 having an outlet chamber 35 which is characterized by a generally conical contour in the radially outer region of its closure wall 36. Member 34 is seen to have an inward flange 37 for mounting to an associated pump housing 38 and a formed sheet-metal annular member 39 with a suitably contoured central opening provides the idler-stop function discussed at 13, 13' in connection with FIGS. 1 and 2. Each of the bodies 33 is seen in FIGS. 7 and 8 to be a gas-encapsulating molded product integrally incorporating a reinforcement member 40 of expanded metal, having a radial-flange portion 41 and a cylindrically arcuate flange portion 42. The radial-flange portion 41 is near and parallel to flange 37; the other axial end 43 of body 33 is axially opposite and conforms to a truncated frusto-conical wall of chamber 35. A central longitudinally extending bore 44 in the body 33 coincides with a tapped bolt aperture 45 in the reinforcement member 40, so that, for each body 33, one of the bolts 46 which secures the housing closure member 34 to its associated pump housing 38 may additionally serve to retain the mounted position of the attenuator body. Although the bodies 33 of FIGS. 5 to 8 do not have the tapered crescent configuration of FIGS. 1 to 4, they will each be seen to avoid opposed parallel surfaces and thus to minimize the chance of singular frequencies of resonance development.

Figure 9:
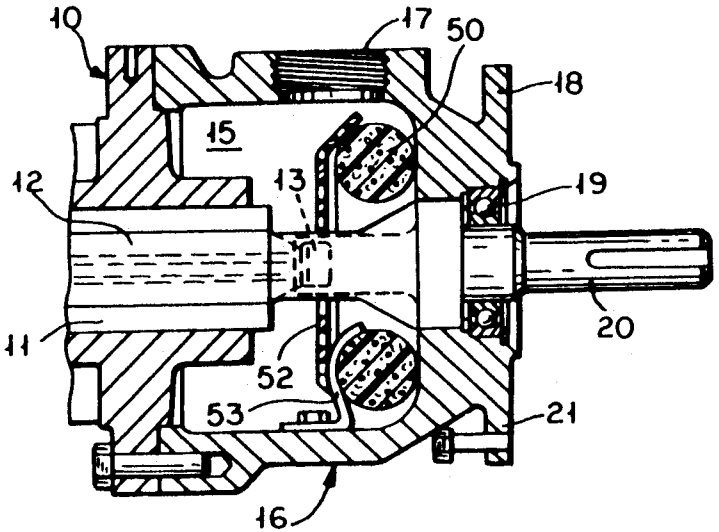
FIG. 9 is a fragmentary view in longitudinal section of the driven end of a screw pump to show a further embodiment of the invention.

In the alternative arrangement of FIG. 9, the configuration of an attenuator 50 within the outlet chamber 15 of FIG. 1 is seen as a torus, surrounding and spaced from the pump shaft 20, and retained by a suitably open cage structure 52 which may be clamped at 53 or otherwise retained to a wall of chamber 15; as shown, the cage structure 52 comprises a formed annular piece of expanded metal, peripherally dished in welded assembly to a plurality of clamp brackets 53, only one of which appears in FIG. 9. A self-locking bolt 54 secures each clamp bracket to closure member 16. The torus of attenuator 50 need not be molded with a reinforcement, since the retainer structure 52, 53 provides adequate support. But the attenuator-volume preferences and encapsulated gas-volume relationships within molded elastomeric material remain in the same ranges, whatever the geometry of the individual attenuator body or bodies.

Figure 2:
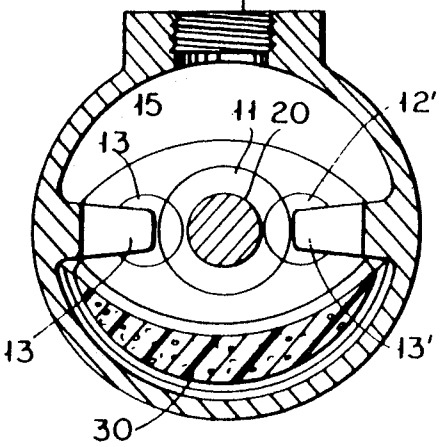
FIG. 2 is a section, taken at 2—2 of FIG. 1.
Figure 11:
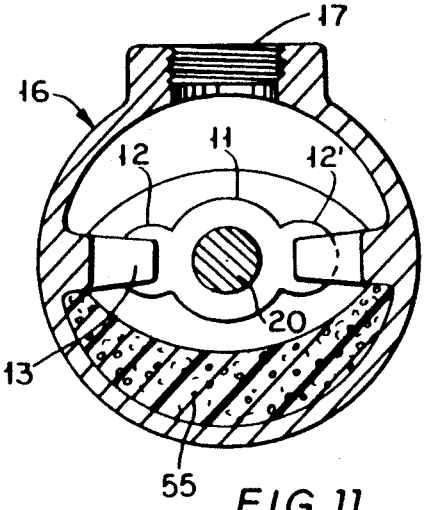
FIG. 11 is a view similar to FIG. 2, for the embodiment of FIG. 10 and taken at 11—11 in FIG. 10.
Figure 10:
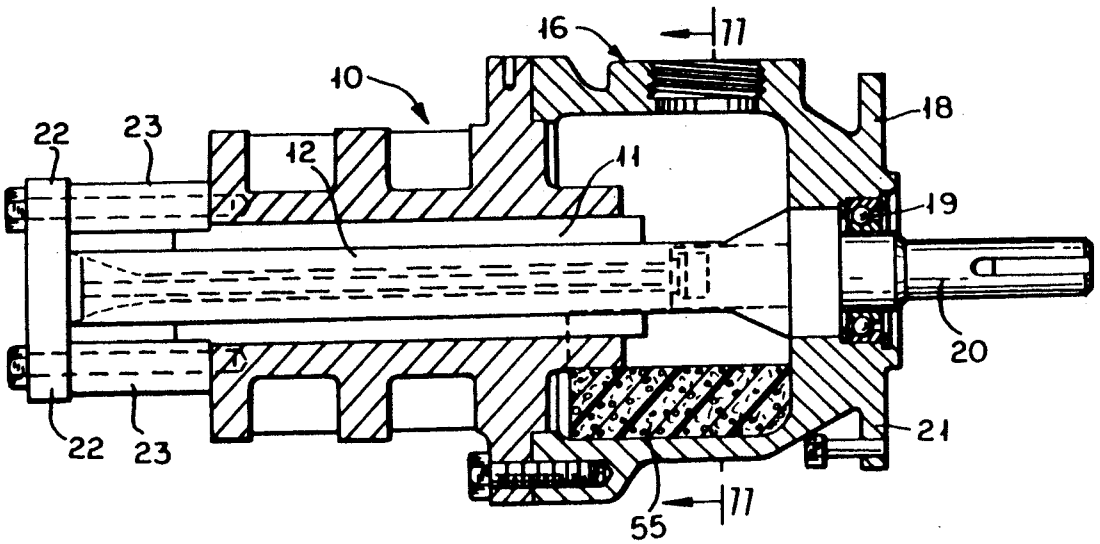
FIG. 10 is a view similar to FIG. 1, for a further embodiment of the invention.

The embodiment of FIGS. 10 and 11 will be recognized for similarity to FIGS. 1 and 2, with the exception that the attenuator element 55, having essentially the cylindrical crescent configuration of attenuator 30 in FIGS. 1 and 2, is in fact an unreinforced permanently molded component of end closure 16, having been either preformed for conformance to the adjacent inner wall profile of chamber 15, prior to adhesively bonded assembly thereto, or having been insitu molded to the chamber wall, as a finishing operation in the manufacture of the end-closure component 16.

What is claimed is:

1. A displacement-type hydraulic pump, comprising a rotor-housing part having axially spaced inlet and outlet ends and a cover part secured to the outlet end of said rotor-housing part, an elongate rotor having a pumping portion within said rotor-housing part and a driven portion journalled for rotation in said cover part, said cover part coacting with the outlet end of said rotor-housing part to define an annular chamber surrounding a portion of said rotor for receiving pumped hydraulic fluid discharged at the outlet end of said rotor-housing part, said chamber having an outlet port for discharge of pumped hydraulic fluid from said chamber, and a body of foamed elastomeric material retained within said chamber at offset from said outlet port, said body of elastomeric material having a volume that is in the range of 0.1 to 0.3 of the volume of said chamber.

2. The pump of claim 1, wherein said body of elastomeric material consists of encapsulated gas to the extent of 20 to 35 percent of the overall volume of said body.

3. The pump of claim 1, wherein said body of elastomeric material consists of encapsulated gas to the extent 25 to 30 percent of the overall volume of said body.

4. The pump of claim 1, wherein the overall volume of said body of elastomeric material is in the range of 0.15 to 0.25 of the volume of said chamber.

5. The pump of claim 1, wherein said cover part is cup-shaped, with a skirt having an open end secured to said rotor-housing part, and with a closed end at the outer end of said skirt and providing journalled support of said rotor, said outlet port being at an angularly local region of said skirt.

6. In a hydraulic pump wherein a driven mechanical element within a stationary housing is operative to displace hydraulic fluid from an inlet chamber to an outlet chamber having an outlet port, the improvement wherein a body of foamed elastomeric material is contained within said outlet chamber at offset from said outlet port, said body of elastomeric material having a volume that is in the range of 0.1 to 0.3 of the volume of said chamber.

7. The improvement of claim 6, wherein said body is retained by adherence to an inner-wall portion of said outlet chamber.

8. The improvement of claim 6, wherein said body is in intimate foamed adherence to and conformance with an inner-wall portion of said outlet chamber.

* * * * *